US006645566B2

(12) United States Patent
Ko

(10) Patent No.: US 6,645,566 B2
(45) Date of Patent: Nov. 11, 2003

(54) PROCESS FOR HEAT TREATMENT NITRIDING IN THE PRESENCE OF TITANIUM AND PRODUCTS PRODUCED THEREBY

(76) Inventor: Jong Ho Ko, 6165 Edgewater St., Doraville, GA (US) 30340

( * ) Notice: Subject to any disclaimer, the term of this patent is extended or adjusted under 35 U.S.C. 154(b) by 0 days.

(21) Appl. No.: 10/152,136

(22) Filed: May 21, 2002

(65) Prior Publication Data

US 2003/0049386 A1 Mar. 13, 2003

Related U.S. Application Data

(63) Continuation-in-part of application No. 09/323,237, filed on Jun. 1, 1999, now abandoned.

(51) Int. Cl.[7] ..... B05D 1/18; B05D 3/02; C23C 8/48

(52) U.S. Cl. ..... 427/435; 427/376.1; 427/419.7; 427/443.2; 145/238

(58) Field of Search ..... 427/376.1, 419.7, 427/431, 435, 443.2; 148/212, 228, 231, 232, 238

(56) References Cited

U.S. PATENT DOCUMENTS

| | | | | | |
|---|---|---|---|---|---|
| 3,639,641 | A | * | 2/1972 | Saton | 148/228 |
| 4,019,928 | A | * | 4/1977 | Beyer et al. | 148/228 |
| 4,332,653 | A | * | 6/1982 | Satoh | 148/228 |
| 4,492,604 | A | * | 1/1985 | Muller et al. | 148/228 |

* cited by examiner

*Primary Examiner*—Michael Barr
(74) *Attorney, Agent, or Firm*—Smith, Gambrell & Russell, LLP

(57) ABSTRACT

A method for nitriding a metallic base material at low temperatures in a salt bath containing electrolyzed titanium metal. A nitride coating of exceptional depth and hardness is obtained in a very short operating time due to the rapid nitriding process. The method is applicable to steel, titanium, aluminum and alloys thereof.

17 Claims, No Drawings

PROCESS FOR HEAT TREATMENT NITRIDING IN THE PRESENCE OF TITANIUM AND PRODUCTS PRODUCED THEREBY

This is a continuation-in-part of U.S. patent application Ser. No. 09/323,237, filed Jun. 1, 1999, now abandoned.

FIELD OF THE INVENTION

The present invention relates to a low temperature process for nitriding metals in the presence of electrolyzed titanium. The nitrided metal products have enhanced hardness and a thick nitride layer. The low temperature of the process prevents or lessens warping and twisting of the metal, two disadvantages of prior art processes.

BACKGROUND OF THE INVENTION

This invention relates to a titanium nitriding heat treatment (TNHT) process which uses titanium as a catalyst for low temperature nitriding of a variety of base metals, including SUS carbon steels and steel alloys, aluminum and aluminum alloys, titanium and titanium alloys, and others.

This invention relates to an improved process for the formation of a specific barrier layer, i.e. a protective nitride coating, on a substrate material surface. This coating is more strongly bonded to the surface than coatings formed by conventional processes.

Nitride coatings have been commercially used as protective coatings which resist corrosion, wear, and erosion. Titanium nitride, because of its excellent properties, has attracted considerable attention.

A useful coating is only as good as the strength of the bond between the coating and the substrate material. Good adhesion is an important prerequisite in engineering a commercially useful coating process. For this reason, a number of nitride coating processes have been developed, each attempting to improve the interfacial strength between the coating and the substrate material.

Nitride coating processes in use today include Physical Vapor Deposition (PVD), Chemical Vapor Deposition (CVD), and Ion Assisted Coating (IAV), as well as a combination of these processes.

A problem with known coating processes is that the processes can leave contaminants in the interface layer between the coating and the substrate. These contaminants weaken the bond and cause eventual delamination of the coatings. Such coating processes usually start with a cleaning procedure that uses ion sputtering to remove contaminated compounds, such as sulfides, etc., from the cold substrate material surface that is to be coated. However, during the coating process the substrate material is heated, usually to a temperature between 1100° F. and 2200° F. Any sulfur present in the substrate material will then diffuse from the bulk substrate material to segregate at the surface causing the formation of stable sulfides. These sulfides interfere with the application of the coating and markedly decrease the adherence of the coating.

The solution to this problem, as described in this invention, is to use a specific salt bath, electrolyzed metallic titanium, and a soaking temperature which greatly reduces or eliminates the possibility of such formation.

Conventional nitriding techniques require long activation and nitriding at high temperatures (over 760° C.) to coat a base material. Other techniques reduce the activation and nitriding time, but require high temperature electrolysis in the presence of a titanium catalyst. Such is disclosed in U.S. Pat. No. 4,332,653 to Satoh. Alternatively, the temperature of nitriding has been accomplished at lower temperatures (below 500° C.), as disclosed in U.S. Pat. No. 4,332,653 to Satoh, by utilizing electrolysis and a titanium catalyst, but such method is only applicable to the low carbon, or low alloy-low carbon steels.

The effectiveness of these processes is limited in that high temperatures cause the base metal being nitrided to warp or twist. In addition, electrolysis and/or long activation and nitriding times are inconvenient and inefficient. Consequently, an efficient, low temperature nitriding process which forms a thick, hard nitride layer on a variety of base materials is desirable.

The present invention relates to a new and improved process for coating a variety of base metals that overcomes these problems and quickly produces a strong adherent nitride layer at low temperatures without the use of electrolysis during the nitriding process.

SUMMARY OF THE INVENTION

The method of the present invention is directed to a new and improved nitriding process. Many different types of metals, including SUS carbon steels (S15C—S50C), aluminum, aluminum alloys, high-speed steel (SK, SKS, SCM, SNC, SKH9, SKD-11, SKD-61, D2), titanium, titanium alloys, FC 25, SS41, and others can be used as a base material with the present method.

In the method of the present invention, the base metal advantageously is soaked for from about 2 to about 10 hours at a temperature of from about 430° to about 670° C. in a salt bath in which activated-electrolyzed titanium metal is added. A thick, hard nitriding layer of from about 20 to about 100 microns is formed on the metal.

According to the method of the present invention, a nitride coating of exceptional hardness and depth results that cannot be achieved by conventional techniques. In addition, the lower temperature of the present invention avoids causing warping or twisting of the base material. As a result, certain kinds of metals that were previously unable to be nitrided by traditional nitriding processes, such as S35C, SS41, and SUS steels, Ti, Al, and others can be nitrided using a heat treatment with a titanium catalyst.

The widened variety of potential base materials, the increased hardness of the metals, and increased resistance to wear that result from the present process, has a high potential for use in, among others, the airplane, space, watchmaking, tool-making, gun-making, and auto industries.

DESCRIPTION OF THE PREFERRED EMBODIMENT

In the present invention, a moderately heated non-electrolyzed salt bath is used which contains activated-electrolyzed metallic titanium.

Sodium dioxide and a salt selected from the group consisting of sodium cyanate and potassium cyanate, in amounts of from about 80 to about 85 w/w %, is present in the salt bath with from about 15 to about 20 w/w % of $NaCO_2$ or sodium chloride. To the bath is added from about 2 to about 20 micrograms of electrolyzed metallic titanium. A base metal material is soaked in the bath for from about 2 to about 10 hours at from about 430 to about 670° C. The titanium catalyzes the formation of a thick, hard nitride layer of from about 20 to about 100 microns on the base material.

The present invention includes a method for nitriding a base metal material comprising providing a base metal material, providing a salt bath which includes sodium dioxide and a salt selected from the group consisting of sodium cyanate and potassium cyanate, dispersing electrolyzed metallic titanium in said bath, heating the salt bath to a temperature ranging from about 430° to about 670° C.; and soaking the material in the salt bath for a time of from about 2 to about 10 hours. Advantageously, the soaking time ranges from about 2 to about 6 hours. The metal base material is preferably selected from the group consisting of steel, carbon steel, steel alloys, titanium, titanium alloys, aluminum, aluminum alloys and the salt bath is a non-electrolyzed salt bath. Advantageously, the salt bath includes from about 15 to about 20 w/w % of an added salt selected from the group consisting of sodium carbon dioxide, sodium carbonate, and sodium chloride. The soaking temperature advantageously ranges from about 500° to about 650° C., preferably from about 530° to about 630° C.

The method of the present invention is particularly effective where the salt bath is non-electrolyzed, the base material is selected from the group consisting of steel, carbon-steel, steel alloys, titanium, titanium alloys, aluminum, and aluminum alloys, the salt bath includes from about 15 to about 20 w/w % of an added salt selected from the group consisting of sodium carbon dioxide, sodium carbonate, and sodium chloride, and the soaking time ranges from about 2 to about 6 hours with a soaking temperature in the range of from about 500° to about 650° C.

The present invention further includes a composition of matter comprising a metal base material selected from the group consisting of steel, carbon steel, steel alloys, titanium, titanium alloys, aluminum, and aluminum alloys, a hardened nitride layer coating the metal base material which has a depth from about 12 to about 30 microns, and a diffusion nitride layer coating the hardened nitride layer of the metal base material, wherein said diffusion nitride layer has a depth from about 54 to about 2000 microns. Advantageously, the metal base material is selected from the group consisting of aluminum and aluminum alloys, the hardened nitride layer has a depth of about 25 microns, the diffusion nitride layer has a depth from about 100 to about 525 microns and the surface hardness of the metal base material having the hardened nitride layer is from about 800 to about 1500 HV. Preferably, the surface hardness of the metal base material having the hardened nitride layer is from about 800 to about 1150 HV. The composition of the present invention is particularly advantageous where the base material is carbon steel SC35, the hardened nitride layer has a depth of about 25 microns, the diffusion nitride layer has a depth of about 2000 microns, and the surface hardness of the metal base material having the hardened nitride layer is about 1150 HV. Also advantageous is where the base material is aluminum, the hardened nitride layer has a depth of about 25 microns, the diffusion nitride layer has a depth of from about 100 to about 500 microns, and the surface hardness of the metal base material having the hardened nitride layer is from about 480 to about 550 HV.

EXAMPLE 1

1. Stainless SUS 30 was used as a base material. This base material was nitrided by soaking in a heated salt bath (80 w/w % of NaCNO and 20 w/w % of $NaCO_2$), for 5 hours at 540° C. in which 2–20 micro grams of electrolyzed metallic titanium was added. This material was then cooled and dried. The material was then washed to remove the oxidation layer formed during heat treatment and tested as follows:

| | | | | | |
|---|---|---|---|---|---|
| 1. Hardness. | | | | | |
| Load (g) | 25 | 50 | 100 | 200 | 300 |
| Hardness (H · V) | 1324 | 1320 | 1310 | 1283 | 1208 |
| 2. Depth of nitriding layer. | | | | | |
| | 30–50 | microns (First layer—hardened layer) | | | |
| | 100–120 | microns (Second layer—diffusion layer) | | | |
| Total: | 130–170 | microns | | | |

EXAMPLE 2

An aluminum ingot (AL 7075) was used as the base material. This material was nitrided by soaking in a heated salt bath (80 w/w % of NaCNO and 20 w/w % of $NaCO_2$), for 5 hours at 540° C., to which (need exact amount) 2–20 micro grams of electrolyzed metallic titanium was added. This material was then cooled and dried. The material was then washed to remove the oxidation layer formed during heat.

| | | | |
|---|---|---|---|
| 1. | | | |
| Load (g) | 25 | 50 | 100 |
| Hardness (H.V) | 550 | 530 | 480 |
| 2. Depth of nitriding layer | | | |
| | 25 | microns (first layer - hardened layer) | |
| | 500 | microns (second layer - diffusion layer) | |
| Total: | 525 | microns | |

By catapulting this heat treated AL ingot within 72 hours, strong bars, which can be used as construction materials, automobile parts, and machinery parts etc., can be produced.

EXAMPLE 3

The process of Example 1 was performed using various base materials. The results are set forth in Table 1 below.

TABLE 1

| Base Material | Temp (C.) | Time (hr) | HV (100 g) | First layer-Hardened layer (microns) | Second layer-diffusion layer (microns) | Quenching |
|---|---|---|---|---|---|---|
| SKS | 650 | 5 | 908 | 15 | 100 | water, oil |
| SUS304 | 540 | 5 | 1500 | 30 | 200 | " |
| SKH-9 | 580 | | 1288 | 16 | 54 | " |
| SUS 420J2 | 530 | 3–5 | 1084 | 17 | 150 | ambience |
| S35C | 650 | 6 | 1150 | 25 | 2000 | water (fast) |
| SCM4 | 650 | 6–8 | 800–1030 | 12–20 | 800 | ambience |
| SKD-61 | 570 | 6 | 1017 | 30 | 100 | " |
| SACM1 | 515 | 8–10 | 1100 | 30 | 100 | " |
| S25C | 630 | 3 | 847 | 15 | 600 | water |
| S45C | 650 | 5 | 950 | 15 | 600 | water |
| FC25 | | | | 20–25 | 400 | water |
| AL 7075 | 470 | 4 | | 25 | 100 | water |
| D-2 | 600–650 | 5 | 2200 | 30 | 150 | water |

Depending on the temperature and time of the present process, the thickness of hardened nitride layers and nitride diffusion layers will vary. These results indicate that the arrangement of the atoms on the surface of the base material and inside the metal are very uniform. Consequently, the process achieves a material with high hardness in which desquamation is minimized.

It will be seen from the above examples and data that excellent results are obtained by the method of the present invention.

What is claimed is:

1. A method for nitriding a base metal material comprising:

(a) providing a base metal material selected from the group consisting of titanium, titanium alloys, aluminum, and aluminum alloys;

(b) providing a salt bath which includes sodium dioxide and a salt selected from the group consisting of sodium cyanate and potassium cyanate;

(c) dispersing metallic titanium formed by electrolysis of a titanium compound, in said bath;

(d) heating the salt bath to a temperature ranging from about 430° to about 670° C.; and (e) soaking the material in the salt bath for a time of from about 2 to about 10 hours.

2. The method of claim 1 wherein the soaking time in step (e) ranges from about 2 to about 6 hours.

3. The method of claim 1 wherein said salt bath is a non-electrolyzed salt bath.

4. The method of claim 1 wherein said salt bath includes from about 15 to about 20 w/w % of an added salt selected from the group consisting of sodium carbon dioxide, sodium carbonate, and sodium chloride.

5. The method of claim 1 wherein the soaking temperature in step (e) ranges from about 500° to about 650° C.

6. The method of claim 5 wherein the soaking temperature in step (e) ranges from about 530° to about 630° C.

7. The method of claim 3 wherein said salt bath includes from about 15 to about 20 w/w % of an added salt selected from the group consisting of sodium carbon dioxide, sodium carbonate, and sodium chloride.

8. The method of claim 7 wherein the soaking time in step (e) ranges from about 2 to about 6 hours.

9. The method of claim 8 wherein the soaking temperature in step (e) ranges from about 500° to about 650° C.

10. The method of claim 9 wherein the soaking temperature in step (e) ranges from about 530° to about 630° C.

11. The method of claim 1 wherein the material is soaked in step (e) until a hardened nitride layer coating the metal base material is formed which has a depth from about 12 to about 30 microns.

12. The method of claim 11 wherein the material is soaked in step (e) until a diffusion nitride layer coating the hardened nitride layer of the metal base material is formed having a depth from about 54 to about 2000 microns.

13. The method according to claim 12 wherein said metal base material is selected from the group consisting of aluminum and aluminum alloys; the hardened nitride layer has a depth of about 25 microns, and said diffusion nitride layer has a depth from about 100 to about 525 microns.

14. The method according to claim 11 wherein the surface hardness of the metal base material having the hardened nitride layer is from about 800 to about 1500 HV.

15. The method according to claim 14 wherein the surface hardness of the metal base material having the hardened nitride layer is from about 800 to about 1150 HV.

16. The method of claim 12 wherein the hardened nitride layer has a depth of about 25 microns, the diffusion nitride layer has a depth of about 2000 microns, and the surface hardness of the metal base material having the hardened nitride layer is about 1150 HV.

17. The method of claim 12 wherein the base material is aluminum, the hardened nitride layer has a depth of about 25 microns, the diffusion nitride layer has a depth of from about 100 to about 500 microns, and the surface hardness of the metal base material having the hardened nitride layer is from about 480 to about 550 HV.

* * * * *